US006161409A

United States Patent [19]

Friese

[11] Patent Number: 6,161,409

[45] Date of Patent: Dec. 19, 2000

[54] PROCESS AND DEVICE FOR MANUFACTURING A GEAR PART WITH OUTER TEETH

[75] Inventor: Udo Friese, Ahlen, Germany

[73] Assignee: WF-Maschinebau und Blechformtechnik GmbH & Co. Kommanditgessellschaft, Schormelweg, Germany

[21] Appl. No.: 09/230,503

[22] PCT Filed: Sep. 3, 1996

[86] PCT No.: PCT/DE96/01641

§ 371 Date: Jun. 26, 1999

§ 102(e) Date: Jun. 26, 1999

[87] PCT Pub. No.: WO98/06521

PCT Pub. Date: Feb. 19, 1998

[30] Foreign Application Priority Data

Aug. 14, 1996 [DE] Germany ..... 196 32 704
Aug. 30, 1996 [DE] Germany ..... 196 35 152

[51] Int. Cl.[7] ..... B21H 5/00

[52] U.S. Cl. ..... 72/110; 29/893.32

[58] Field of Search ..... 72/82, 84, 87, 72/110; 29/893.32

[56] References Cited

U.S. PATENT DOCUMENTS 3,261,192 7/1966 Saito et al. ..... 62/87
4,273,547 6/1981 Bytzek .
4,485,656 12/1984 Nilson et al. ..... 672/84
5,562,785 10/1996 Yamanaka ..... 29/893.32

FOREIGN PATENT DOCUMENTS 0 140 576 5/1985 European Pat. Off. .
0 333 917 9/1989 European Pat. Off. .
0 343 314 11/1989 European Pat. Off. .
0 493 792 7/1992 European Pat. Off. .
0 565 225 10/1993 European Pat. Off. .
40 06 582 9/1990 Germany .
39 32 823 12/1990 Germany .
42 05 711 8/1993 Germany .
42 44 720 3/1994 Germany .

*Primary Examiner*—Lowell A. Larson
*Attorney, Agent, or Firm*—Barnes & Thornburg

[57] ABSTRACT

A process is disclosed for manufacturing a gear part with outer teeth from a metallic workpiece shaped as a circular blank or predrawing. The gear part has a hub surface with outward projecting teeth. The workpiece is flattened in its circumferential area and the teeth are formed without cutting by a toothed roller (5) mounted in a freely rotary manner. While the teeth are formed by flattening the workpiece, the toothed roller (5) is fixed in the radial direction so as to not move towards the feeding axis of the spindle. The edge of a circular blank may be curled or thickened or the cylindrical edge of a potshaped predrawing may be collapsed.

8 Claims, 6 Drawing Sheets

PROCESS AND DEVICE FOR MANUFACTURING A GEAR PART WITH OUTER TEETH

Figure 1:
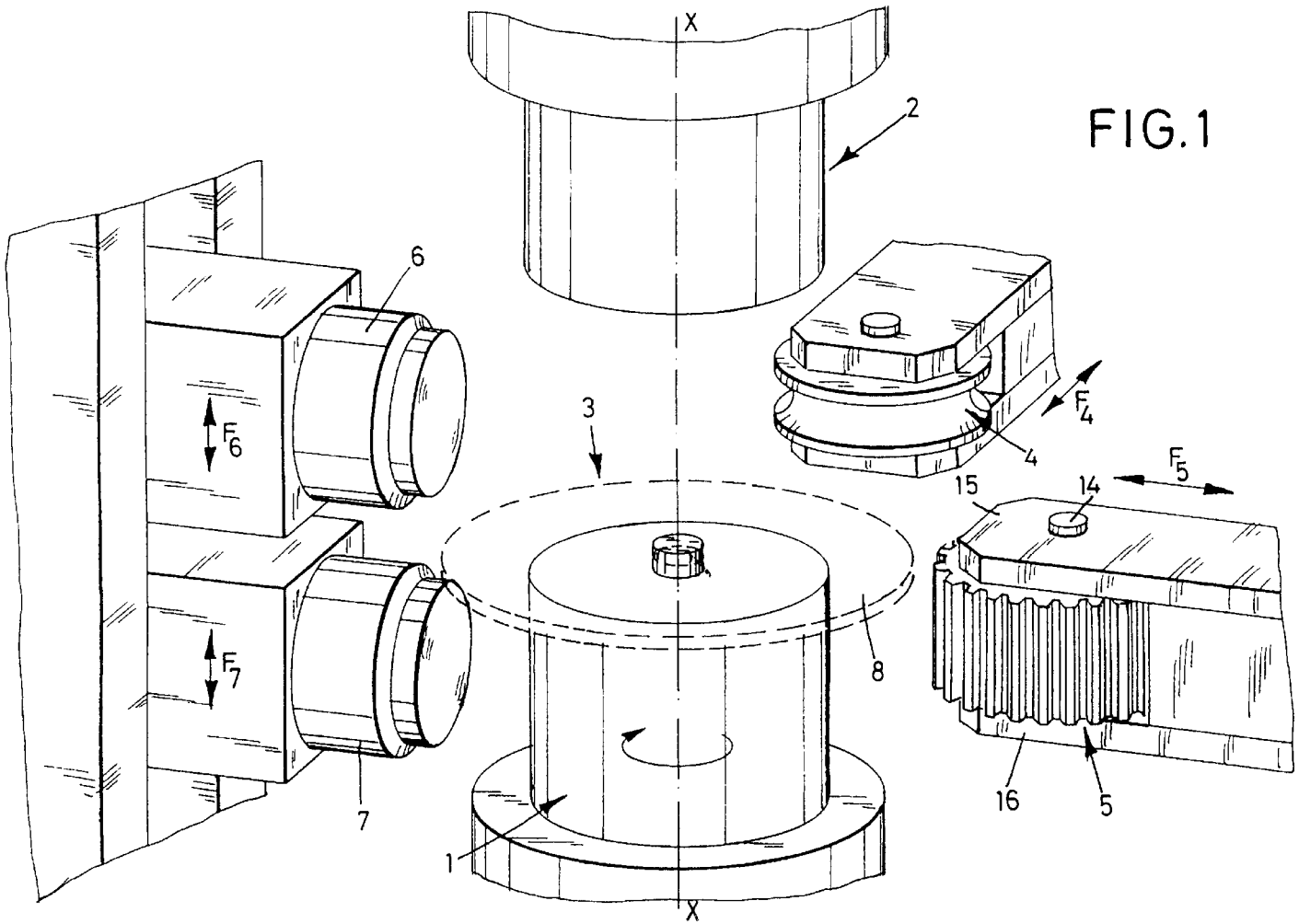

The invention relates to a method of producing an externally toothed gear part from a metallic workpiece that is in the form of a blank or a predrawn part. The gear part so produced has a hub face with teeth projecting outward therefrom. The invention also relates to an apparatus for producing an externally toothed gear part having a hub face with teeth projecting outward therefrom.

Externally toothed gears are used on a large scale, for example, as flywheels for shift transmissions or starters in motor vehicle construction. Such gear parts were hitherto produced by the flywheels, for example, being designed in two pieces. In this case, the flywheel disk was produced from cold-worked plate and the external tooth system was formed in a separate ring by means of a chip-producing forming method. The ring was then welded to the flywheel disk. This known arrangement has the disadvantage that it is costly and that material changes, which cannot be fully ascertained, are induced in the flywheel by the welding process.

In order to reduce the total weight of a gear part, while retaining sufficient strength, in both the disk region and the region of the external tooth system, it has already been proposed in EP-0 333 917 A2 that the external tooth system be formed from a marginal region of the plate blank, the marginal region being thickened relative to the latter before the external tooth system is formed, in such a way that the cross section of the external tooth system is larger than the cross section of a correspondingly long ring zone having the plate thickness of the plate blank.

To this end, before the forming of the external tooth system, the relevant marginal region is thickened by means of suitable sheet-metal working processes; such as upsetting or the like, as a result of which structural changes are induced in the material. Since carbon steel is normally used for these gear parts, hardening, which is disadvantageous for the subsequent working process, inevitably occurs. In this embodiment, the teeth are then formed by hammering them in according to a method which likewise belongs to the prior art. Furthermore, this second-mentioned procedure has the disadvantage that the tooth flanks may repeatedly turn out to have inadequate load-bearing capacity, so that the teeth may break under high loads. In addition, the known arrangement has the disadvantage that the teeth are not only formed on the outside of the marginal region of the blank; on the contrary, a tooth-like undulation of this marginal region is also made at the rear toward the interior of the blank, so that quite considerable generation of noise occurs as a result during rotation of the wheel.

EP-0 140 576 A1 has disclosed a flywheel which is produced from a pressed part, i.e. a predrawn part, in which case teeth provided on the outside of an axially extending section are produced by rolling. The drawing shows this component as if the inner ring of the teeth is of smooth design. This method has the disadvantage that a predrawn part is taken as a basis, the wall thickness of the axially extending cylindrical region corresponding exactly to the wall thickness of the hub face, so that either the root rim of the toothed ring is too thin and too weak, so that the teeth may break, or else the hub face is too thick, so that here material is wasted and an undesirable increase in weight occurs.

DE-40 06 582 A1 discloses a method of producing a gear wheel, in which method the toothed roller rotates about an axis which is disposed in the circumferential direction of the workpiece to be worked, and in which the metal-forming work is split up into a multiplicity of individual metal-forming steps, i.e. the teeth are hammered into the margin of the workpiece, so that destruction of the structure occurs, i.e. the grain flow of the metal is destroyed and fractures may subsequently occur here.

In the procedure according to DE-39 32 823 C1, the teeth are also pressed into an axial surface, the thickness of which corresponds to the wall thickness of the hub face.

U.S. Pat. No. 4,273,547 has disclosed a method of producing belt pulleys or multiple V-pulleys, in which method a metal blank is deep-pressed in a first step of the method, so that a pot-like pressed part is obtained. This pressed part has the same wall thickness in the region of the hub face and in the region of the cylindrical surface extending coaxially, i.e. essentially perpendicularly, to the hub face. It is subsequently necessary to fine-machine the marginal region of the cylindrical surfaces formed. So-called "collapsing" of the cylindrical marginal surface follows as the next step of the method. By this "collapsing", the cylindrical marginal surface is reduced in its height by deformation, the marginal region between the hub face and the cylindrical surface being folded in at the same time. The marginal region which is thus collapsed is then formed and compressed by a pressure closing roller.

This known method therefore requires essentially five successive, absolutely essential working steps, the forces to be applied for the collapsing being considerable, so that considerable outlay is required in terms of mechanical equipment.

A method of producing a belt pulley is described in EP-A-343 314, in which a metal blank is flanged in its circumferential region and then the flanged portion is pressed flat to form a bearing surface, and grooves which run in the circumferential direction are then made in the bearing surface which is thus formed, or it is also possible to incorporate transverse tooth systems in this bearing surface, so that a transversely toothed belt pulley is produced. However, since the material of the flanged portion has already been compacted in order to form the bearing surface, special demands are made on the production of the tooth system, i.e. the tooth system is made in a compacted metal part.

DE 42 05 711 C1, establishing the generic type, has disclosed a method of producing an externally toothed precision gear part from a metal blank, having a hub face and an encircling toothed ring, which is formed from a root rim and teeth projecting outward thereon and extends essentially perpendicularly to the hub face, the metal blank being flanged in its circumferential region, and the flanged portion being pressed flat, i.e. being shaped without chip removal, while the teeth are simultaneously formed in a receiving space of a toothed roller. In this case, after the flanging, a toothed roller is fed in to the flanged portion and, by further infeed of the toothed roller, the flanged portion is pressed into the intermediate space between the teeth, so that the encircling toothed ring is thereby formed. Here, coupling between the rotationally driven workpiece and the rotationally driven forming tool, namely the toothed roller, is necessary, which in the known proposal is effected by a chain. The synchronization of the rotationally driven workpiece and the rotationally driven tool requires high forces and constant readjustment of the position of the two components relative to one another.

The object of the invention is to provide a method and an apparatus with which the synchronization of the workpiece with the tool is no longer necessary and the gear part can be produced cost-effectively, structural changes in the tooth region of the gear produced being avoided. Furthermore, reworking of the workpieces produced is to be largely avoided.

This objective of the invention is achieved in a method of producing an externally toothed gear part from a metallic workpiece that is in the form of a blank or a predrawn part. The gear part so produced has a hub face with teeth projecting outward therefrom. The workpiece is pressed flat in its circumferential region and the teeth are formed without chip removal using a toothed roller. The toothed roller is freely rotatable and is set in a fixed position in a radial position toward a spindle/presetting-element axis (X—X) during formation of the teeth, which is effected by pressing the workpiece flat.

The invention is also found in an apparatus for producing an externally toothed gear part from a metallic workpiece that is in the form of a blank or a predrawn part. The apparatus has a mounting device for securing the workpiece between a spindle and a presetting element, a toothed roller, and two pressure rollers that can press flat the margin of the workpiece. The toothed roller is positioned in a radial direction so that a tooth tip line of the toothed roller bears against an outer circumference of the workpiece prior to pressing flat the workpiece.

The apparatus can further include one or more flanging rollers for thickening the margin of the workpiece. A collapse ring which is movable in the direction of the spindle/presetting-element axis (X—X) can also be included, and can act as a supporting chuck during formation of the teeth. The apparatus can also include a performing roller for producing collapse lines and can also include one or more supporting rollers or a supporting ring that bears against the top side of the predrawn part.

Figure 2:
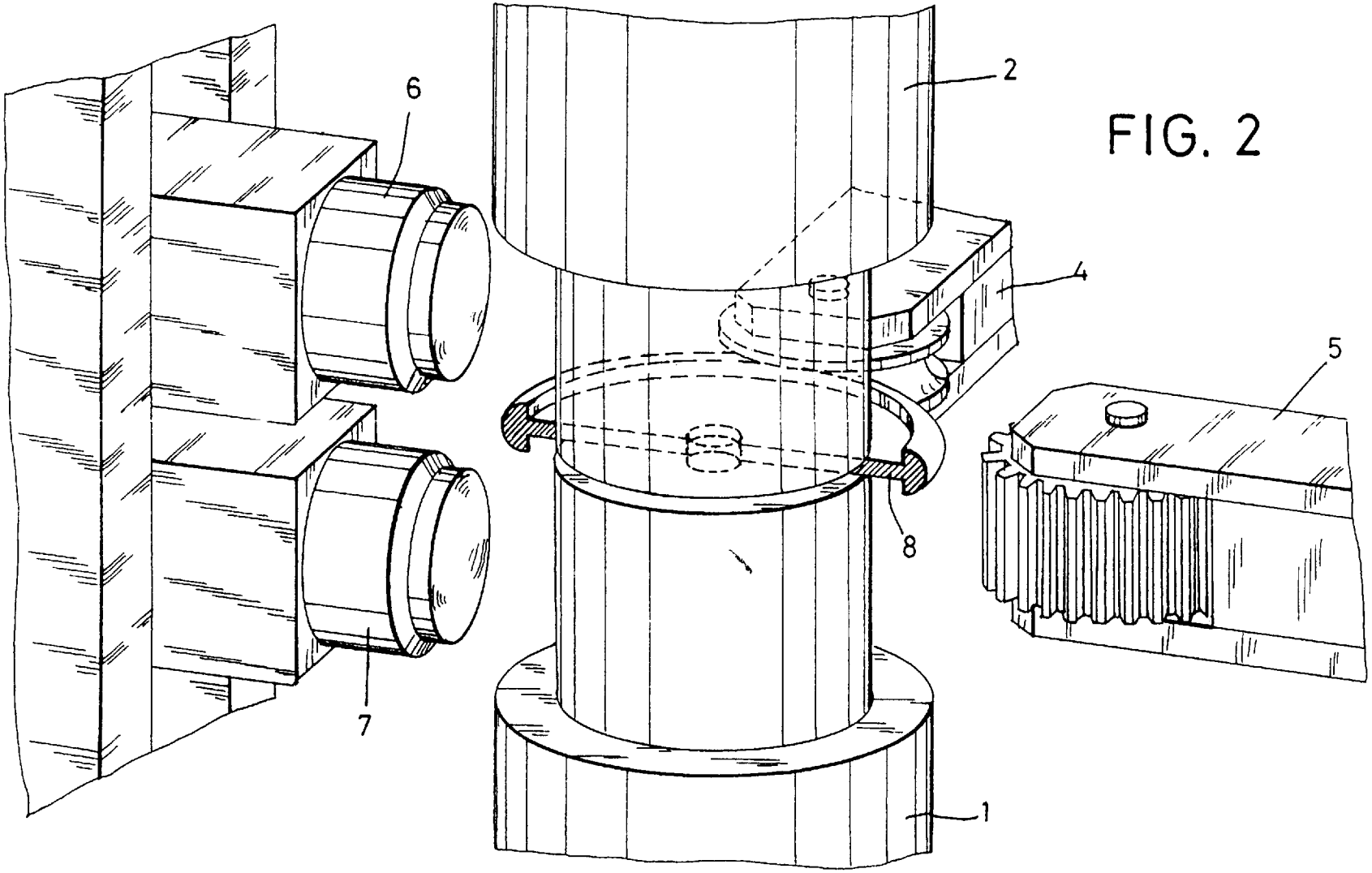
Figure 3:
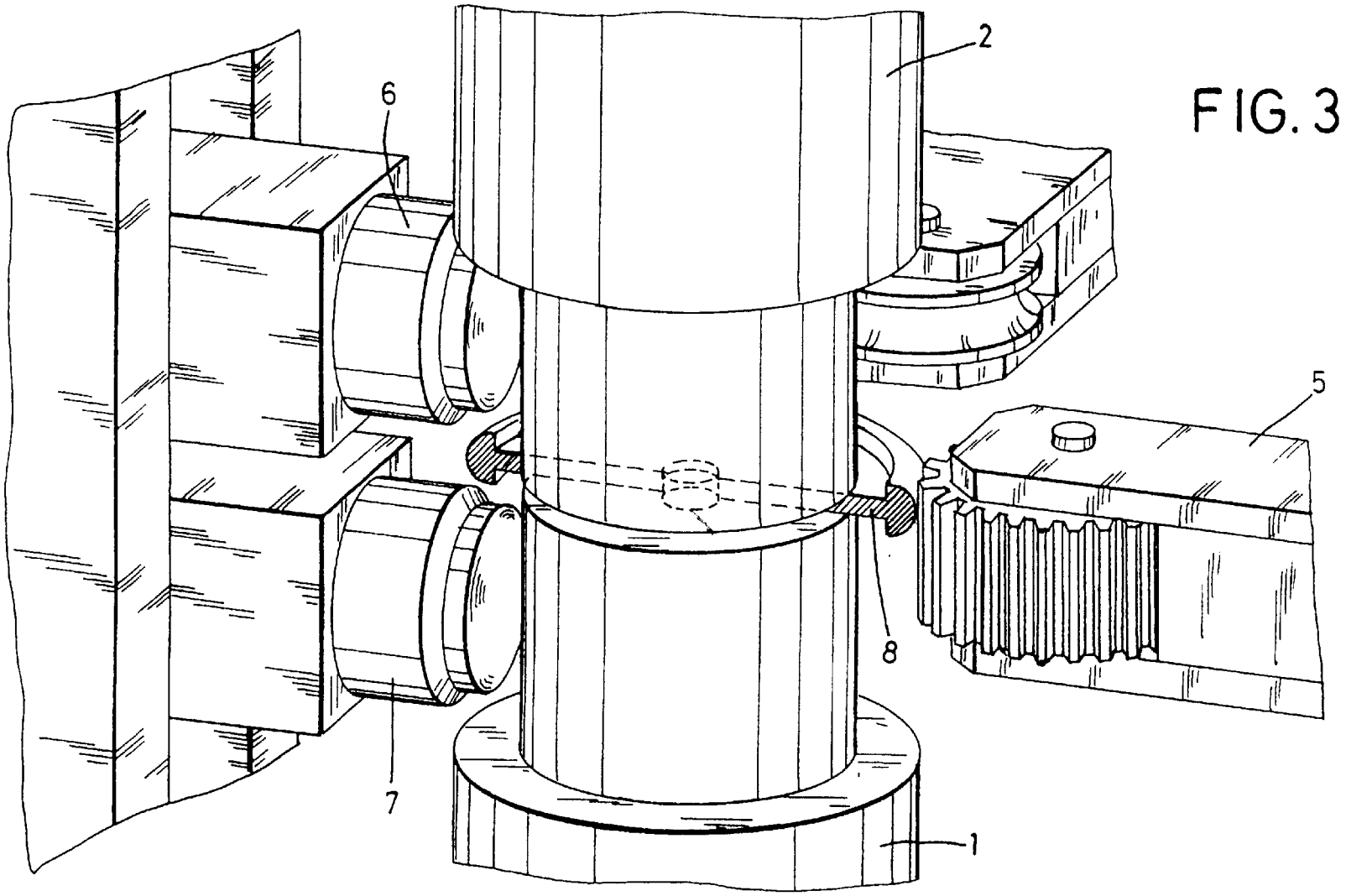
Figure 4:
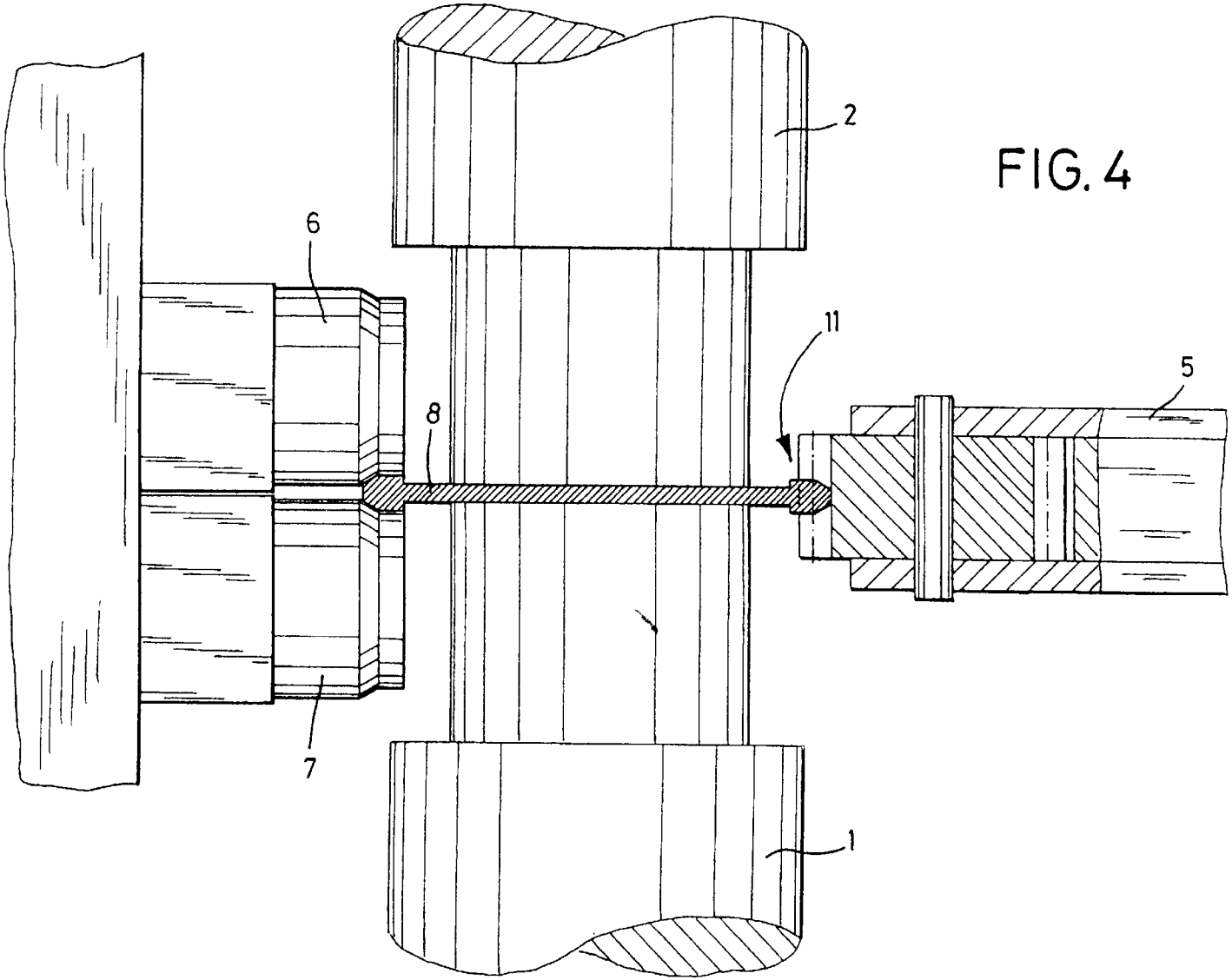
Figure 5:
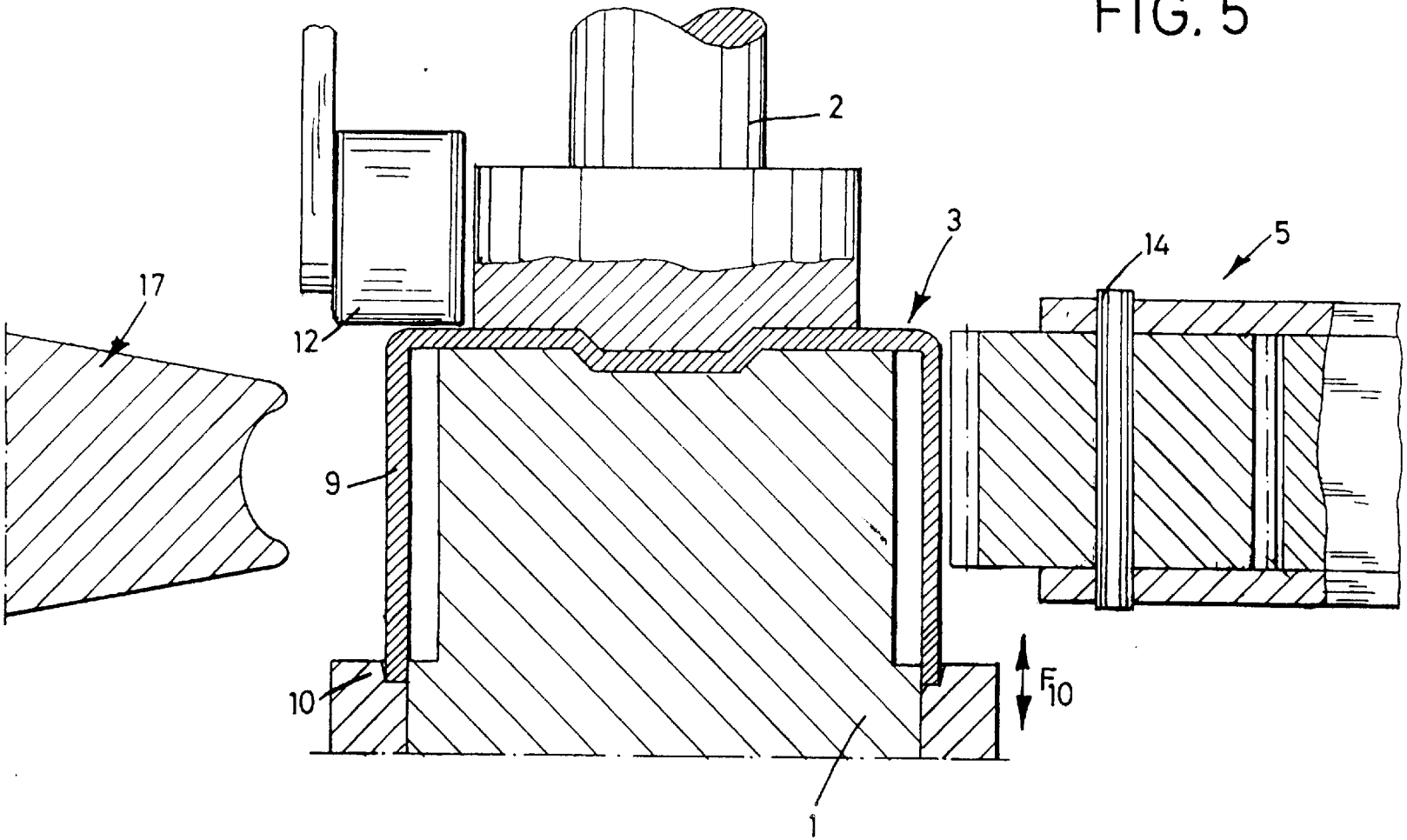
Figure 6:
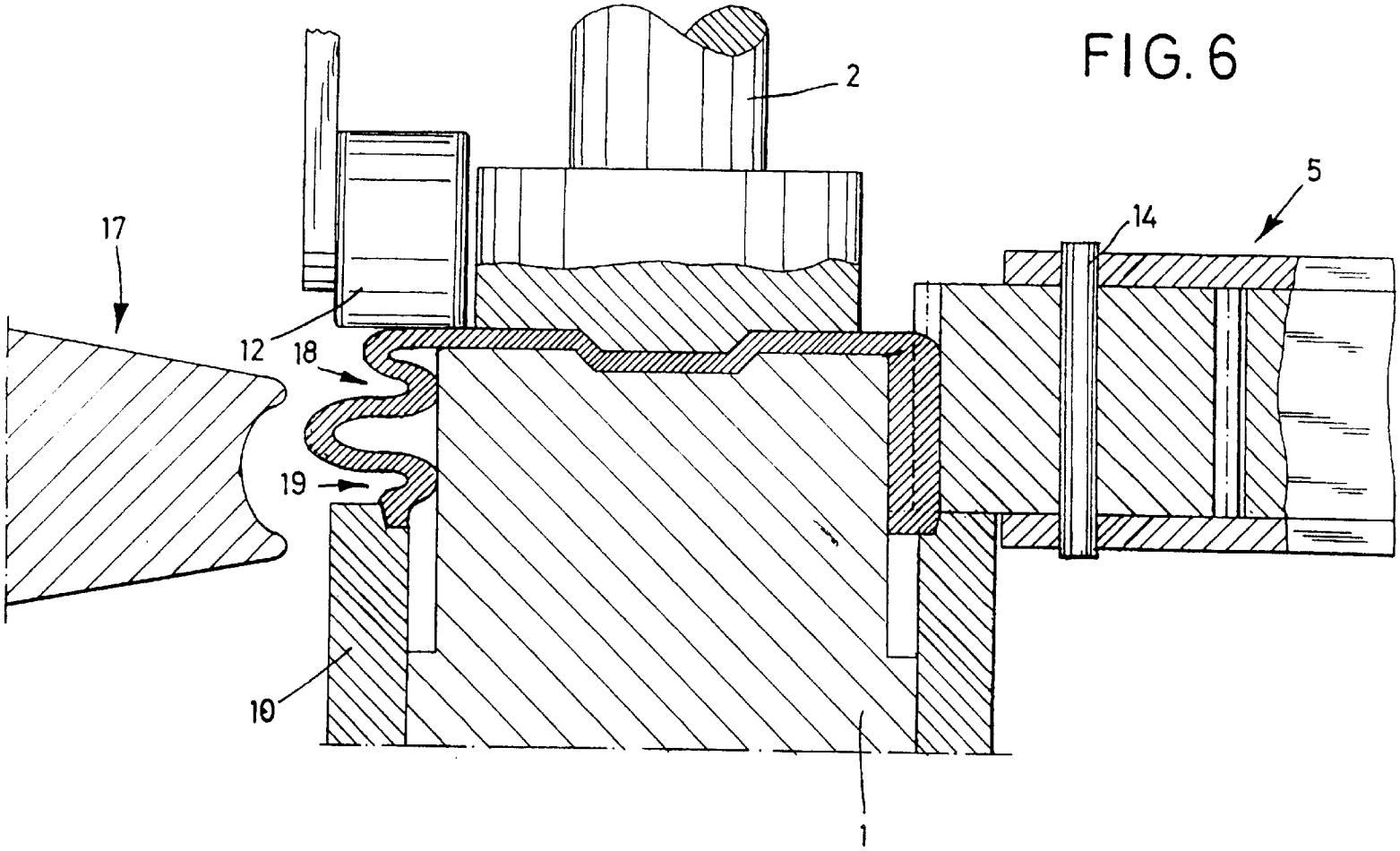

Exemplary embodiments of the invention are explained below with reference to the drawings, in which:

FIG. 1 shows a diagrammatic, but relatively schematic, arrangement for forming a toothed gear part from a blank in the initial state, FIG. 2 shows the arrangement according to FIG. 1 after the marginal region of the blank has been thickened, FIG. 3 shows the arrangement according to FIGS. 1 and 2 after the forming roller has moved up to the outer circumference of the thickened blank, and FIG. 4 shows a partly sectioned representation of the pressure rollers brought together and of the toothed marginal region pressed into the tooth spaces of the toothed roller, FIG. 5 schematically shows an embodiment with an inserted predrawn part as workpiece, and FIG. 6 shows a representation according to FIG. 5, in which the marginal region of the predrawn part is collapsed and inserted into the tooth spaces of the forming roller.

In the drawings, a spindle is shown at 1 and a raised presetting element is shown at 2. On its top side, the spindle 1 carries a workpiece 3, which is formed as a blank 8. Shown at 4 is a flanging or upsetting roller, which can be moved up to the workpiece 3 in the direction of arrow $F_4$. A toothed roller 5 can be moved up to the workpiece 3 in the direction of arrow $F_5$, although the toothed roller 5 is mounted in appropriate supports 15 and 16 so as to be freely rotatable about its axis 14.

Shown opposite the toothed roller 5 are two pressure rollers 6 and 7, which are movable toward one another and away from one another in the direction of arrows $F_6$ and $F_7$. The flanging or upsetting roller 4 or a plurality of rollers may be designed in accordance with the requirements, i.e. they may be designed to be half round for example, as shown in FIG. 1, but other shapes are also perfectly possible. In particular, the flanging or upsetting roller 4 may be designed in such a way that the thickened portion obtained is formed symmetrically to the plane of the blank 8 or is formed to the one or the other side, depending on which form of the gear wheel is to be achieved. Thus, for example, when a starter ring is to be produced, the thickened portion is configured in such a way that the toothed ring which is formed extends essentially perpendicularly to the one or the other side of the hub face of the gear part. The toothed ring which is formed may also be oriented centrically relative to the hub face of the gear part.

In the same way, it is possible to design the effective surfaces of the pressure rollers 6 and 7 in such a way that, for example, the chamfer which can be seen from the drawings is provided. There are other design possibilities here too.

FIG. 2 shows that the flanging roller 4 has moved up to the blank 8 and has formed, i.e. thickened, the margin of the latter in a semicircular shape. Both the toothed roller 5 and the pressure rollers 6 and 7 are in their initial position according to FIG. 1.

FIG. 3 shows that now, as a next step, the toothed roller 5 has moved in the radial direction up to the outer circumference of the thickened blank 8 and touches said outer circumference. During the further working process, however, the toothed roller 5 stays in this position, i.e. it is not moved into the material of the blank 8.

If, as can be seen from FIG. 4, the thickened marginal region of the blank 8 is now compressed by the pressure rollers 6 and 7, the material of the thickened marginal region of the blank 8 flows into the spaces between the projecting teeth of the toothed roller 5 and forms the externally toothed gear part.

In the embodiment according to FIG. 5, a spindle 1 and a presetting element 2 are again shown, and this spindle 1 and presetting element 2 secure a workpiece 3 between them, the workpiece 3 being formed as a predrawn part 9. The predrawn part 9 is therefore a cylindrical, pot-shaped part, the outer marginal edges of which are centered in a collapse ring 10, which is movable in the direction of arrow $F_{10}$ in FIG. 5. By radial infeed, a forming roller 17 produces one or more predetermined buckling points, also called collapse lines 18 and 19.

The top side of the workpiece 3 is supported by a supporting roller 12. Here, however, it is also possible for the presetting element 2 to have such a size that it serves at the same time as supporting roller for the marginal edges of the predrawn part 9. Two or more supporting rollers may also be provided. The toothed roller is shown at 5. If, as shown in FIG. 6, the pot-shaped marginal region of the predrawn part 9 is now collapsed by the collapse ring 10, it arches outward, as shown on the left in FIG. 6, in which case this arched region, when it passes into the region of the toothed roller 5, flows into the spaces between the teeth of the toothed roller 5, i.e. the teeth are thus formed by being worked into the roller, which, although rotatable, is fixed in the direction toward the presetting-element/spindle axis X—X. The teeth are thus formed by constant infeed of the collapse ring 10 up to the end position.

It may be especially pointed out that the embodiments shown are merely schematic representations for illustrating the operations. Additional retaining rollers in order to avoid the formation of flash and additional supporting rollers in order to prevent an escape of material during the forming operations may of course be provided.

Separate steps of the method which are carried out on individual machines may be advantageous. Thus, the mounting tool may be optimally adapted to the workpiece to be obtained and to the respective step of the method. In accordance with the thickness of the blank, a plurality of flanging or thickening rollers may be used.

What is claimed is:

1. A method of producing an externally toothed gear part from a metallic workpiece blank, wherein the gear part has a hub face with teeth projecting outward thereon, the method comprising steps of:

providing a workpiece;

using a flanging roller to provide a thickened margin in the workpiece;

moving a toothed roller, which is mounted so as to be freely rotatable, into a fixed position in a radial direction toward a spindle/presetting-element axis(x—x);

subsequently using two pressure rollers to press flat the thickened margin of the workpiece; and forming teeth;

wherein the teeth are formed by flowing of the material of the metallic workpiece into the toothed roller, the flowing of the material being caused by the workpiece being pressed flat.

2. An apparatus for producing an externally toothed gear part from a metallic workpiece in the form of a blank for carrying out the method of claim 1, the apparatus comprising:

a mounting device configured to secure the workpiece between a spindle and a presetting element;

a toothed roller wherein the toothed roller can be set in a fixed position in the radial direction so that a tooth tip line of the toothed roller can lie on the thickened margin of the workpiece before the latter is pressed flat, and two pressure rollers configured to press flat the margin of the workpiece between them.

3. The apparatus of claim 2, further comprising one or more flanging rollers for thickening the margin of the workpiece.

4. A method of producing an externally toothed gear part from a metallic workpiece in the form of a pot-shaped predrawn part, the gear part having a hub face with teeth projecting outward thereon, the method comprising steps of:

clamping the workpiece in position between a spindle and a presetting element, subsequently collapsing a cylindrical workpiece margin of the pot-shaped predrawn part in a direction of the spindle/presetting-element axis, and forming the teeth in a toothed roller without chip removal, wherein the collapsed region is formed by being worked into the toothed roller, which is freely rotatable but is in a fixed position in a radial direction.

5. An apparatus for carrying out the method of claim 4 for producing an externally toothed gear part from a metallic workpiece in the form of a potshaped predrawn part, the gear part having a hub face with teeth projecting outward thereon, the apparatus comprising:

a spindle and a presetting element for securing the workpiece;

a collapse ring that is movable in a direction of a spindle/presetting-element axis (X—X); and a toothed roller, wherein the toothed roller is freely rotatable in a fixed position.

6. The apparatus of claim 5, further comprising a preforming roller for producing collapse lines.

7. The apparatus of claim 5, further comprising one or more supporting rollers bearing against the top side of the predrawn part.

8. The apparatus of claim 5, wherein the collapse ring acts as a supporting chuck during the forming of the teeth.

* * * * *